US006827562B1

(12) United States Patent
Barto

(10) Patent No.: US 6,827,562 B1
(45) Date of Patent: Dec. 7, 2004

(54) METHOD OF CONTROLLING SHIFTING OF TWO-SPEED MOTOR

(75) Inventor: Michael W. Barto, Waconia, MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/456,713

(22) Filed: Jun. 6, 2003

(51) Int. Cl.[7] ..... F03C 2/00
(52) U.S. Cl. ..... 418/1; 418/61.3
(58) Field of Search ..... 418/61.3, 1; 60/424

(56) References Cited

U.S. PATENT DOCUMENTS 3,778,198 A * 12/1973 Giversen ..... 418/61.3
3,788,075 A * 1/1974 Holdeman et al. ..... 60/424
3,853,435 A * 12/1974 Ogasahara et al. ..... 418/61.3
3,892,503 A * 7/1975 Getman ..... 418/61.3
4,480,971 A * 11/1984 Swedberg ..... 418/61.3
6,068,460 A * 5/2000 Haarstad et al. ..... 418/61.3
6,099,280 A 8/2000 Bernstrom et al. ..... 418/61.3

* cited by examiner

*Primary Examiner*—Theresa Trieu
(74) *Attorney, Agent, or Firm*—L. J. Kasper

(57) ABSTRACT

A method of controlling shifting of a multiple ratio fluid motor (10) between first and second speed ratios. The motor includes a shift valve (61) operable to achieve the second speed ratio by interconnecting recirculating volume chambers (33R). The method includes providing a pressure control valve (75) in communication with a source (73) of pressure fluid, the valve (75) being operable to communicate a pilot pressure to the shift valve in response to changes in a command signal between a first signal (113B) and a second signal (113C). When a shift to the second condition is commanded, the method changes the command signal (113) from the first to the second over a first time (T1). For a shift back to the first condition (FIG. 3), the method changes the electrical command signal (113) from the second to the first over a second time (T2), wherein T2 is greater than T1.

2 Claims, 5 Drawing Sheets

LSHT

LSHT

HSLT

METHOD OF CONTROLLING SHIFTING OF TWO-SPEED MOTOR

BACKGROUND OF THE DISCLOSURE

The present invention relates to rotary fluid pressure devices of the type in which a gerotor gear set typically serves as the fluid displacement mechanism, and more particularly, to such devices which are provided with multiple-speed (multiple-displacement) capability. Furthermore, the present invention relates to an improved method for controlling the shifting (between different speed ratios) of such a multiple-speed device.

Although the teachings of the present invention can be applied advantageously to devices having fluid displacement mechanisms other than gerotor gear sets (such as radial piston and cam lobe type devices), the present invention is especially adapted for use with devices utilizing gerotor gear sets, and will be described in connection therewith. Furthermore, the present invention is especially adapted for devices which serve as motors during most of their operating cycle, and will be described in connection therewith.

Motors utilizing gerotor gear sets can be used in a variety of applications, one of the more common applications being vehicle propulsion, wherein the vehicle includes an engine driven pump which provides pressurized fluid to a vehicle hydraulic propel circuit, including a pair of gerotor motors, with each motor (typically but not necessarily) being associated with one of the drive wheels. Those skilled in the art will understand that many gerotor motors utilize a roller gerotor gear set, especially on larger, higher torque motors of the type typically used in propel applications, and subsequent references hereinafter to a "gerotor" will be understood to mean and include both a conventional gerotor as well as a roller gerotor. For purposes of this invention, "gerotor" can include either an IGR (internally-generated rotor) or and EGR (externally-generated rotor), both of which are now generally well known to those skilled in the art.

Multiple-speed gerotor motors are known from U.S. Pat. Nos. 4,480,971; 6,068,460; and 6,099,280, all of which are assigned to the assignee of the present invention and incorporated herein by reference. The device of the '971 patent has been in widespread commercial use and has performed in a generally satisfactory manner, and more recently, the devices of the '460 and '280 patents have also come into commercial usage. As is now well know to those skilled in the art, a gerotor motor may be operated as a multiple-speed ratio (multiple displacement) device by providing valving which can effectively "recirculate" fluid between expanding and contracting fluid volume chambers of the gerotor gear set. While the inlet port communicates with all of the expanding volume chambers, and all of the contracting volume chambers communicate with the outlet port, the motor operates in the normal, low-speed, high-torque (LSHT) mode or condition. When some of the fluid from certain of the contracting volume chambers (the "recirculating" chambers) is recirculated back to the expanding volume chambers, the result will be operation in a high-speed, low-torque (HSLT) mode or condition. The HSLT mode yields the same result as if the displacement of the gerotor gear set were decreased, but with the same fluid flow rate through the gerotor.

The multiple-speed gerotor motors, made in accordance with the above-incorporated patents, and sold commercially by the assignee of the present invention, operate very satisfactorily in both the LSHT and the HSLT modes. It has been observed, however, that when the motor is shifted from one mode to the other (and especially, from the HSLT mode to the LSHT mode), there is a tendency for cavitation to occur in the gerotor gear set, just as the shift is occurring from one mode to the other. During the shift from HSLT to LSHT, the effective "displacement" of the motor increases, while the speed of the vehicle and the pump flow remain, at least in the short term, generally constant. Thus, the gerotor gear set is suddenly being "displaced" at a speed corresponding to an instantaneous fluid flow rate which is greater than what the pump can immediately provide.

The recirculating fluid volume chambers have the greatest tendency to cavitate because of greater restriction in the recirculation flow path than in the flow paths to and from those volume chambers which operate normally (don't recirculate). As is well know to those skilled in the art, cavitation occurring within a fluid displacement element, such as a gerotor gear set, causes a substantial amount of undesirable noise, and can also eventually result in damage to the displacement mechanism. Typically, the cavitation will continue until the vehicle slows down to a speed at which the pump flow "catches up with" the speed (displacement) of the gerotor gear set in the motor.

Another problem which has been observed in connection with the process of shifting (again, especially from the HSLT mode to the LSHT mode), is that, if the shift is accomplished too quickly on a vehicle, for example, one moving a load, there will be a tendency for the load to keep moving under its own momentum, even as the vehicle slows down. Thus, there is the potential danger of losing at least part of the load. Finally, the sudden slowing of the vehicle has, on a number of occasions, been observed to cause skidding of the vehicle which, if repeated many times, can result in excessive tire wear.

BRIEF SUMMARY OF THE INVENTION

Accordingly, it is an object of the present invention to provide an improved fluid pressure operated device having multiple-speed ratio capability, in which shifting from one mode to another does not result in any substantial amount of cavitation and noise.

It is a more specific object of the present invention to provide an improved method for controlling the shifting of a multiple-speed ratio fluid pressure operated device, wherein the shifting occurs without any substantial occurrence of the problems associated with the prior art as described above.

It is another object of the present invention to provide an improved method for controlling the shifting of a multiple-speed ratio fluid pressure operated device, wherein each different type of shifting operation can be achieved in a manner most appropriate for that particular shifting operation.

The above and other objects of the invention are accomplished by the provision of an improved method of controlling the shifting of a multiple-speed ratio fluid pressure operated device between a first speed ratio and a second speed ratio, the device including a fluid pressure displacement mechanism defining a plurality of expanding and contracting fluid volume chambers. A motor valve means is operable to provide fluid communication to and from the fluid volume chambers in the first speed ratio. A shift valve means is operable, in a first condition, to achieve the first speed ratio, and in a second condition, to achieve the second speed ratio by interconnecting a plurality of the volume chambers as recirculating volume chambers. The method comprises the step of shifting the shift valve means between the first and second conditions in response to changes in a pilot pressure signal between a first pressure and a second pressure.

The improved method is characterized by providing a pressure control valve in fluid communication with a source of pressurized fluid, the pressure control valve being operable to communicate the pilot pressure signal to the shift valve means in response to changes in an electrical command signal between a first signal and a second signal. When a shift to the second condition is commanded, the method includes changing the electrical command signal from the first signal to the second signal over a first time period T1. When a shift to the first condition is commanded, the method includes changing the electrical command signal from the second signal to the first signal over a second time period T2, wherein T2 is greater than T1.

DETAILED DESCRIPTION OF THE PREFERRED EMBODIMENT

Figure 1:
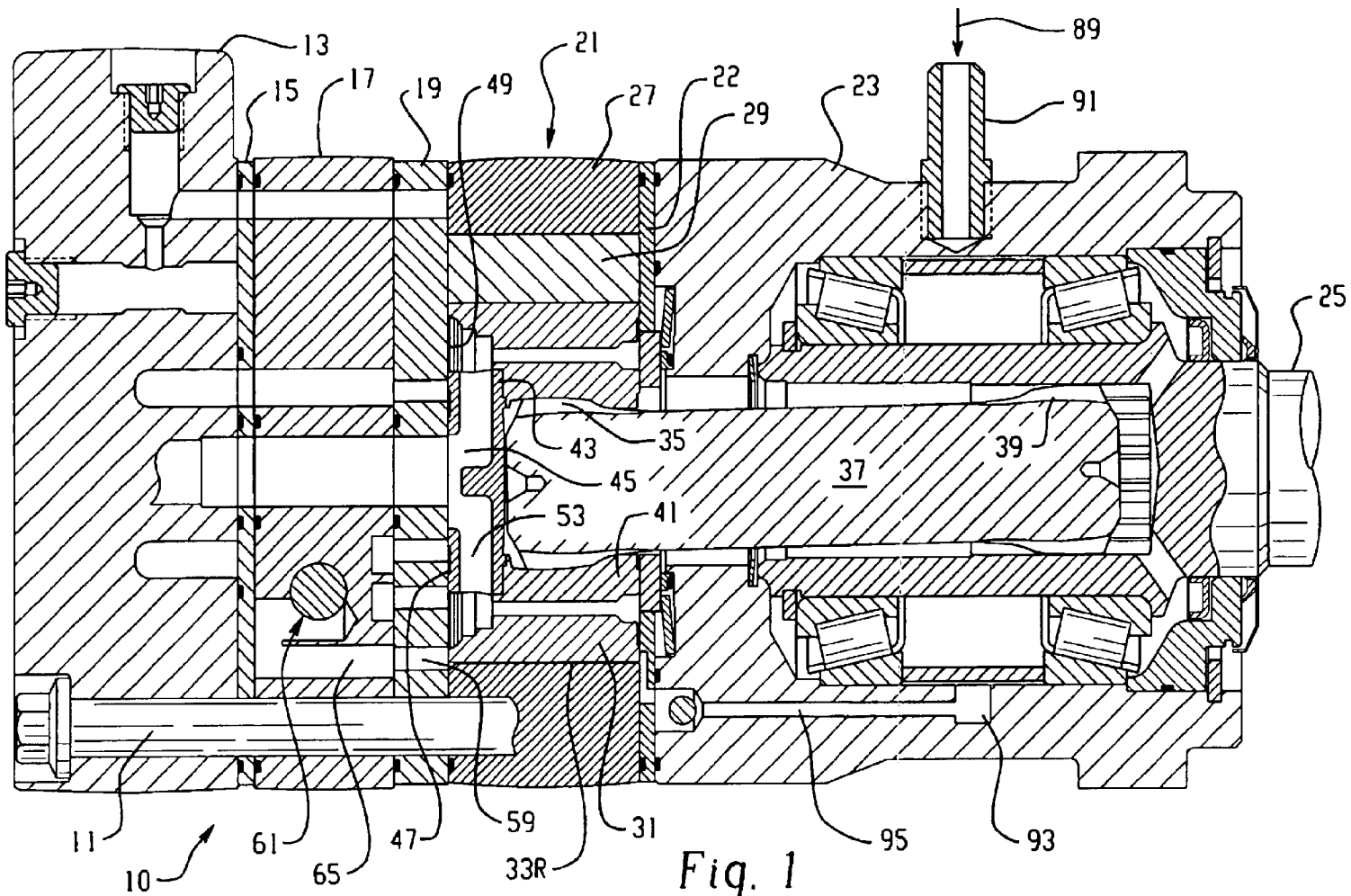
FIG. 1 is an axial cross-section of a low-speed, high-torque gerotor motor of the type which may utilize the improved control method of the present invention.

Referring now to the drawings, which are not intended to limit the invention, FIG. 1 illustrates a valve-in-star ("VIS") type of low-speed, high-torque (LSHT) gerotor motor, generally designated 10, and made generally in accordance with the teachings of U.S. Pat. No. 5,211,551, assigned to the assignee of the present invention and incorporated herein by reference. More specifically, the gerotor motor 10 shown in FIG. 1 is a multiple-speed ratio motor made in accordance with the teachings of the above-incorporated U.S. Pat. Nos. 6,068,460 and 6,099,280. However, it should be understood that the present invention is not limited to a VIS type of gerotor motor, and as was mentioned in the BACKGROUND OF THE DISCLOSURE, the invention is not even limited to only gerotor type devices, but is limited only to the extent specifically set forth in the appended claims.

Figure 2:
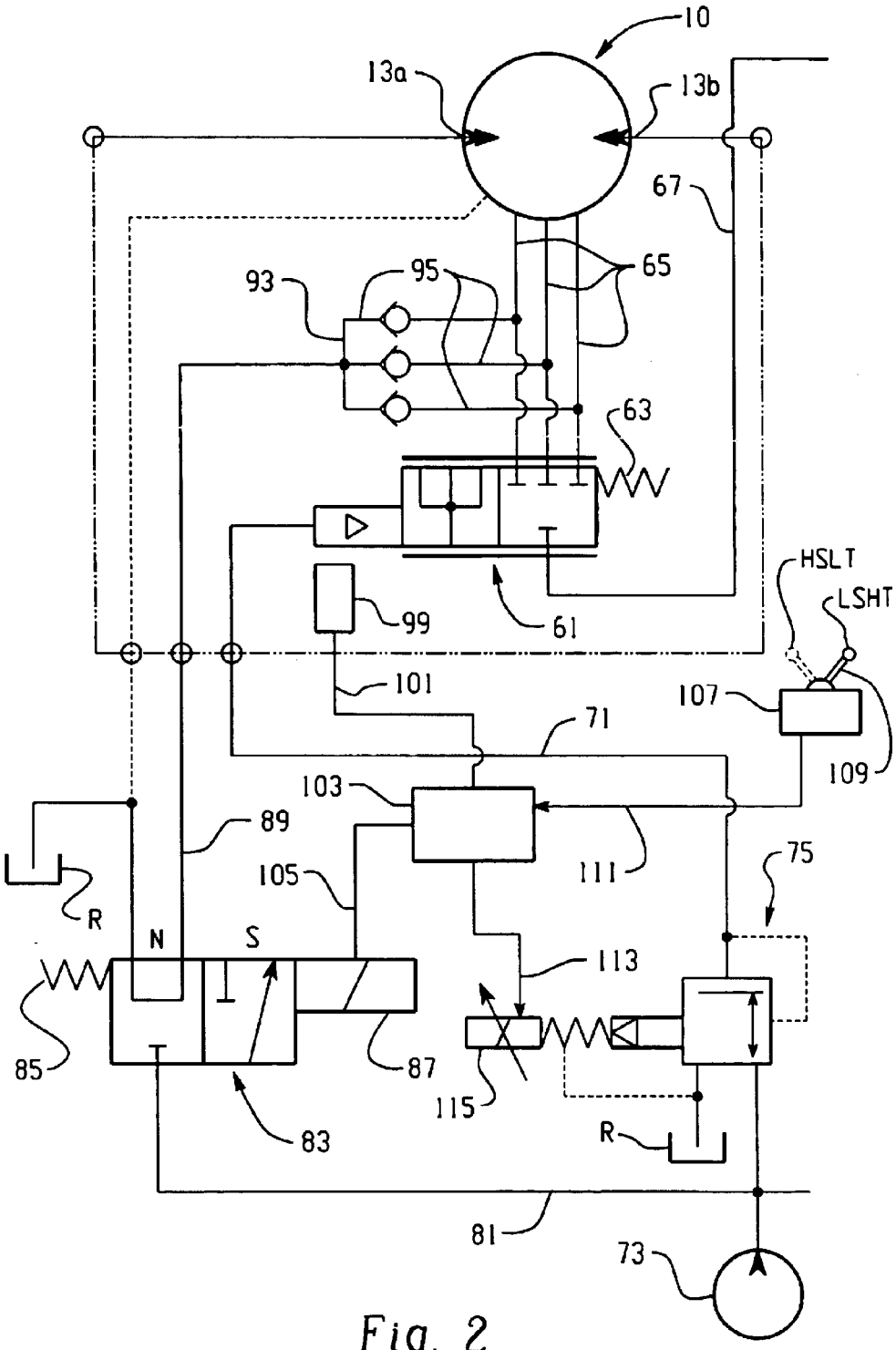
FIG. 2 is a hydraulic schematic of the entire control system for shifting the gerotor motor illustrated in FIG. 1.
Figure 3:
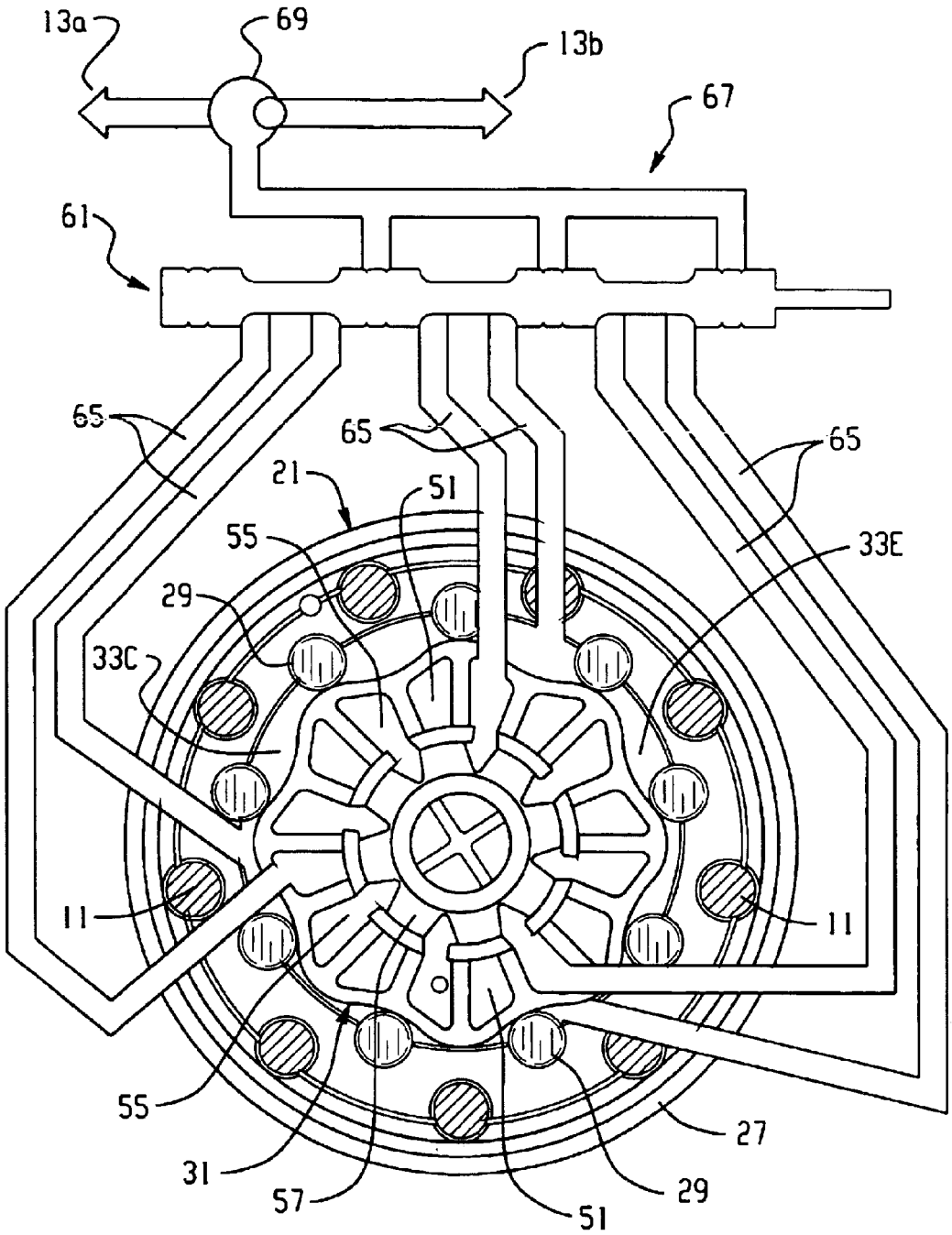
FIG. 3 is a somewhat schematic view, illustrating the gerotor motor of the shiftable type which may utilize the improved control method of the present invention, the motor being in the LSHT mode.
Figure 4:
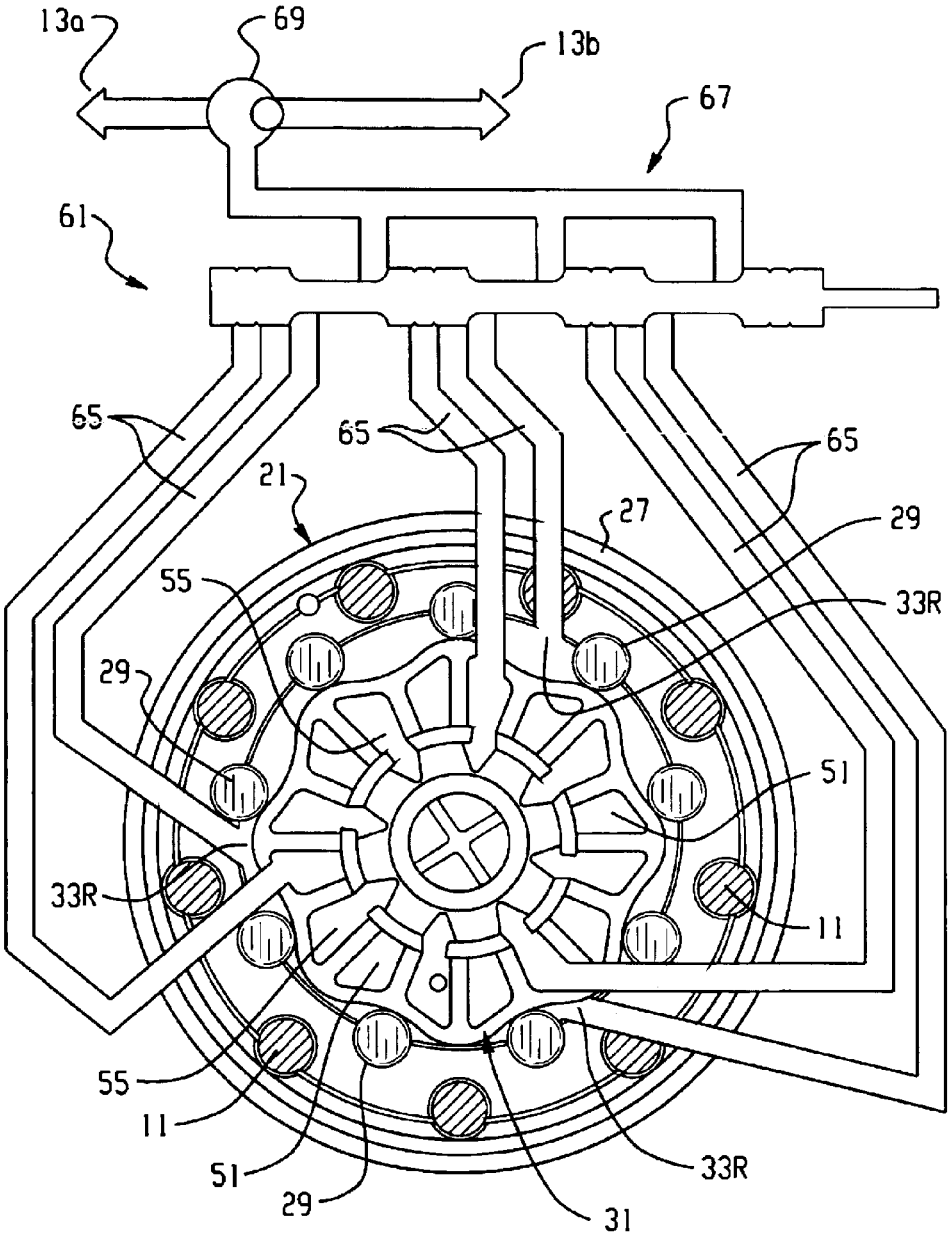
FIG. 4 is a somewhat schematic view, similar to FIG. 3, but illustrating the gerotor motor in the HSLT mode.

The VIS motor 10 shown in FIG. 1 comprises a plurality of sections secured together such as by a plurality of bolts 11, only one of which is shown in FIG. 1, but all of which are shown in FIGS. 3 and 4. The motor includes an end cap 13, a spacer plate 15, a shifter plate 17 (which may also be referred to as a "selector plate"), a stationary valve plate 19, a gerotor gear set, generally designated 21, a balance plate 22, and a forward bearing housing 23, rotatably supporting an output shaft 25. The end cap 13 defines a fluid inlet port 13*a* and a fluid outlet port 13*b* (which are not shown in FIG. 1, for ease of illustration, but which are shown in the schematics of FIGS. 2, 3 and 4). As is well known to those skilled in the motor art, if the port 13*a* becomes the outlet port and the port 13*b* becomes the inlet port, the direction of rotation of the output shaft 25 is reversed.

The gerotor gear set 21, also seen in FIGS. 3 and 4, is well known in the art, is shown and described in greater detail in the above-incorporated patents, and therefore will be described only briefly herein. The gerotor gear set 21 comprises an internally toothed ring member 27, defining a plurality of generally semi-cylindrical openings, with a cylindrical roller member 29 disposed in each of the openings, and serving as the internal teeth of the ring member 27. Eccentrically disposed within the ring member 27 is an externally toothed star member 31, typically having one less external tooth than the number of internal teeth or rollers 29, thus permitting the star member 31 to orbit and rotate relative to the ring member 27. The orbital and rotational movement of the star 31 within the ring 27 defines a plurality of fluid volume chambers 33, each of which, at any given instant in time, is either an expanding fluid volume chamber 33E, or a contracting fluid volume chamber 33C. As is well know to those skilled in the gerotor art, there is also, at any given instant in time, one of the volume chambers which is in a state of "transition" between expanding and contracting. In the subject embodiment, and by way of example only, there is a total of nine volume chambers 33.

Referring still primarily to FIG. 1, the star 31 defines a plurality of straight, internal splines which are in engagement with a set of external, crowned splines 35, formed about one end of a main drive shaft 37. Disposed at the opposite end of the drive shaft 37 is another set of external, crowned splines 39, adapted to be in engagement with a plurality of straight, internal splines, defined by the output shaft 25.

Referring still primarily to FIG. 1, but now in conjunction with FIGS. 3 and 4, the star member 31 will be described in some additional detail. In the subject embodiment, and by way of example only, the star 31 comprises an assembly of two separate parts including a main star portion 41, which includes the external teeth of the star, and an insert or plug 43. The main portion 41 and the insert 43 cooperate to define the various fluid zones, passages and ports which are described in detail in the above-incorporated patents, and therefore, will not be described in detail hereinafter. The star member 31 defines a central manifold zone 45, defined by an end surface 47 disposed in sliding, sealing engagement with an adjacent surface 49 of the stationary valve plate 19.

The end surface 47 of the star 31 defines a set of fluid ports 51, each of which is in continuous fluid communication with the manifold zone 45 by means of a fluid passage 53 defined by the insert 43. The end surface 47 further defines a set of fluid ports 55 which are arranged alternately with the fluid ports 51, each of the fluid ports 55 extending radially inward and opening into an outer manifold zone 57 (shown only in FIG. 3), surrounding the central manifold zone 45. The stationary valve plate 19 defines a plurality of stationary valve passages 59, only one of which is shown in FIG. 1. As the star member 31 orbits and rotates, each of the fluid ports 51 and 55 defined by the insert 43 engages in commutating fluid communication with each of the stationary valve passages 59, thus porting, alternately, high pressure fluid to each volume chamber 33 while it is an expanding volume chamber 33E, and then receiving low pressure fluid from each volume chamber 33, while it is a contracting volume chamber 33C. The valving arrangement just described is well known to those skilled in the gerotor motor art, is illustrated and described in greater detail in the above-incorporated patents, and is referenced hereinafter in the appended claims as the "motor valve means", i.e., the valving which achieves the basic, normal operation of the motor.

Referring now primarily to FIGS. 3 and 4, but also somewhat to FIGS. 1 and 2, the means by which the motor 10 of the present invention achieves multiple speed ratio operation will be described. The motor 10 includes a shift valve spool 61 which, as is shown schematically in FIG. 2, is biased by a compression spring 63 toward a first condition, as shown in FIG. 3, in which the motor 10 is in its normal low-speed, high-torque ("LSHT") mode of operation. As is shown schematically in FIG. 2, and as may be seen in FIG. 1, each volume chamber of the motor which is to recirculate (and therefore is referred to also as a "recirculating volume chamber 33R") is connected, through its respective stationary valve passage 59, by means of a fluid passage 65, to the shift valve spool 61. It should be noted that in FIGS. 3 and 4, each "passage" 65 actually appears, schematically, as two separate passages, one between the shift valve spool 61 and the star port (51 or 55), and the other between the shift valve spool 61 and the recirculating volume chamber 33R. However, for the purposes of the subsequent description and the appended claims, each such "pair" will be referenced merely as "the passage 65".

In the LSHT mode of FIG. 3, the shift valve spool 61 is in a position which isolates each of the passages 65 from the other passages 65, and also isolates each fluid passage 65 from a "source" of recirculation fluid, the source being generically designated "67". As is now well know to those skilled in the two-speed motor art, the source 67 may simply be the inlet port 13*a* (see FIG. 3), and in the case of a bi-directional motor, the source 67 could also be connected to the other port 13*b* (when the port 13*b* is serving as the inlet port). Therefore, some sort of shuttle valve arrangement, generally designated 69, is positioned such that whichever of the ports 13*a* or 13*b* is at the higher pressure will be in fluid communication with the fluid passage comprising the source 67. The structural and operational details associated with the source 67 and the shift valve spool 61 are now well know to those skilled in the art, are not essential to the present invention, and therefore will not be described further herein.

Referring now primarily to FIGS. 2 and 4, the shift valve spool 61 may be shifted, in opposition to the force of the compression spring 63, by a pressure signal 71 which is communicated from a source of pressurized fluid, such as a system charge pump 73. The flow of fluid from the charge pump 73 to the shift valve spool 61 is controlled by a pressure reducing ("pressure control") valve 75, the specific construction and operational details of which are not essential to the present invention, and are beyond the scope of the present invention, and therefore, will not be described further herein. Suffice it to say that the pressure reducing valve 75 is able to control the pressure communicated, as the pressure signal 71, to control the shifting of the shift valve spool 61 from the position shown schematically in FIG. 2 (and in FIG. 3) to the position shown in FIG. 4. The position of the shift valve spool 61 in FIG. 4 comprises a second condition, corresponding to a high-speed, low-torque ("HSLT") mode of operation of the motor 10. In the HSLT mode of operation, the shift valve spool 61 is in a position such that each of the fluid passages 65 is in open communication with the source 67, and therefore, is in communication with each of the other passages 65. As the three recirculating volume chambers 33R expand and contract, the fluid merely flows back and forth among the volume chambers 33R, and through the fluid passages 65 and the source 67. What has been described thus far is in commercial usage and therefore is now generally well known.

Referring now primarily to FIG. 2, in conjunction with FIG. 1, in fluid communication with the output of the charge pump 73 is a fluid conduit 81 which is in communication with the fluid inlet of a solenoid operated control valve 83. The control valve 83 is biased by a compression spring 85 toward a "normal" mode or position ("N") in which the control valve 83 connects a fluid conduit 89 to a system reservoir R. The control valve 83 can be shifted from its normal mode "N" shown in FIG. 2 to a shift mode or position ("S") by an electromagnetic solenoid portion 87, in a manner to be described subsequently. When the control valve 83 is in the shift mode "S", pressurized fluid is communicated from the fluid conduit 81 to the fluid passage 89 (also shown in FIG. 1) which is in fluid communication with the motor 10 at a fitting 91 (shown only in FIG. 1).

Referring now to FIGS. 1 and 2, it may be seen that the forward bearing housing 23 defines an annular chamber 93, and in open communication with the chamber 93 is a plurality of axial fluid passages 95, there being one of the passages 95 for each recirculating volume chamber 33R. Therefore, in the subject embodiment, and by way of example only, there are three of the axial passages 95 (as is shown schematically in FIG. 2). It should be understood that, in order to accomplish the full benefit of the present invention, the fluid passage 89 should be able to communicate with at least each of the recirculating volume chambers 33R, but within the scope of the invention, the fluid passage 89 could be permitted to communicate with all of the volume chambers 33 (in this embodiment, all nine of the chambers).

Preferably, the motor 10 and the control system therefor shown in FIG. 2 are made in accordance with the teachings of co-pending application U.S. Ser. No. 10/282,633, filed Oct. 29, 2002 in the names of Michael W. Barto, Mark D. Schuster, John B. Heckel and Marvin L. Bernstrom for an "Anti-Cavitation System For Two-Speed Motors", assigned to the assignee of the present invention and incorporated herein by reference. In view of the above-incorporation of the co-pending application, certain aspects of the control system shown in FIG. 2 will be described only briefly hereinafter, and only as needed to provide background for the description of the present invention.

Referring now primarily to FIG. 2, when the control valve 83 is in the shift mode "S", pressurized fluid is communicated from the charge pump 73 through the fluid passage 89 to supplement the fluid in at least the recirculating volume chambers 33R (which are shown in FIG. 4). Therefore, the pressurized fluid in the passage 89 flows through the annular chamber 93 and into each of the axial fluid passages 95, providing additional fluid to the respective recirculating volume chamber 33R. The control valve 83 is in the shift mode "S" only while there is a need for supplemental fluid to be communicated to those fluid volume chambers which had been recirculating volume chambers 33R, until the motor was shifted from the HSLT mode to the LSHT mode.

In order to provide the supplemental fluid only when it is truly needed and beneficial, a position sensor 99 is shown in FIG. 2 as being operably associated with the shift valve spool 61 and provides a signal 101 which may be referred to as a "change sense" signal because it indicates a change in the state or sense from the LSHT mode to the HSLT mode (or vice versa). The signal 101 is transmitted to motor control logic, schematically designated 103 in FIG. 2. The control logic 103 receives the change sense signal 101, and when the condition of the signal 101 (e.g., current, duty cycle, etc.) indicates that the shift valve spool 61 is shifting modes (especially, if it is shifting from HSLT to LSHT), then the control logic 103 transmits an appropriate command signal 105 to the solenoid portion 87 of the control valve 83, shifting it from its normal mode "N" to its shift mode "S". Therefore, the control valve 83 is in the shift mode "S" only while the shift valve spool 61 is changing between the HSLT and LSHT modes of operation. However, the position sensor 99 is optional, and the position of the shift spool 61 could merely be assumed (calculated), based on knowing the force versus deflection relationship of the compression spring 63 and that the pilot pressure signal 71 is "commanded", and therefore, known.

Referring still to FIG. 2, the control system shown therein includes a shift module 107, including a shift lever 109, by means of which the vehicle operator may manually select between the LSHT mode (solid lines as shown) and the HSLT mode (dashed lines). The position of the shift lever 109 determines some characteristic (e.g., voltage or current or duty cycle, etc.) of an electrical input signal 111 which is transmitted from the shift module 107 to the motor control logic 103. As may best be seen in FIG. 5, the input signal, generally designated 111 may comprise either a signal 111A, by means of which the motor 10 is commanded from the LSHT mode "up" to the HSLT mode, or a signal 111B, by means of which the motor is commanded from the HSLT mode back "down" to the LSHT mode.

In accordance with one aspect of the present invention, whenever the shift lever 109 is moved from one mode (either LSHT or HSLT) to the other, the change in the input signal 111 (from 111A and 111B, or vice versa) is appropriately noted by the motor control logic 103, which generates an electrical command signal 113. The command signal 113 is transmitted to a solenoid portion 115 of the pressure reducing (pressure control) valve 75. It should be understood by those skilled in the art that the structural and operational details of the pressure control valve 75 are not essential features of the present invention. Instead, all that is essential is that the valve 75 have the capability of varying the pilot pressure signal 71, in response to changes in the electrical input signal 113, between a first signal "level" (corresponding to the input signal 111A) and a second signal "level" (corresponding to the input signal 111B), as that will be illustrated and described in greater detail subsequently.

In the subject embodiment, and by way of example only, the motor control logic 103 includes a Vickers mobile amplifier bearing the part number "731-F16 10 EN39". Included within the amplifier is a microcontroller sold commercially by Microchip Technology, bearing the designation "PIC16C711-I/P". The software to adapt the amplifier to use with the present invention must, of course, be written specifically for the particular application and vehicle, as will now be described in greater detail.

Figure 5:
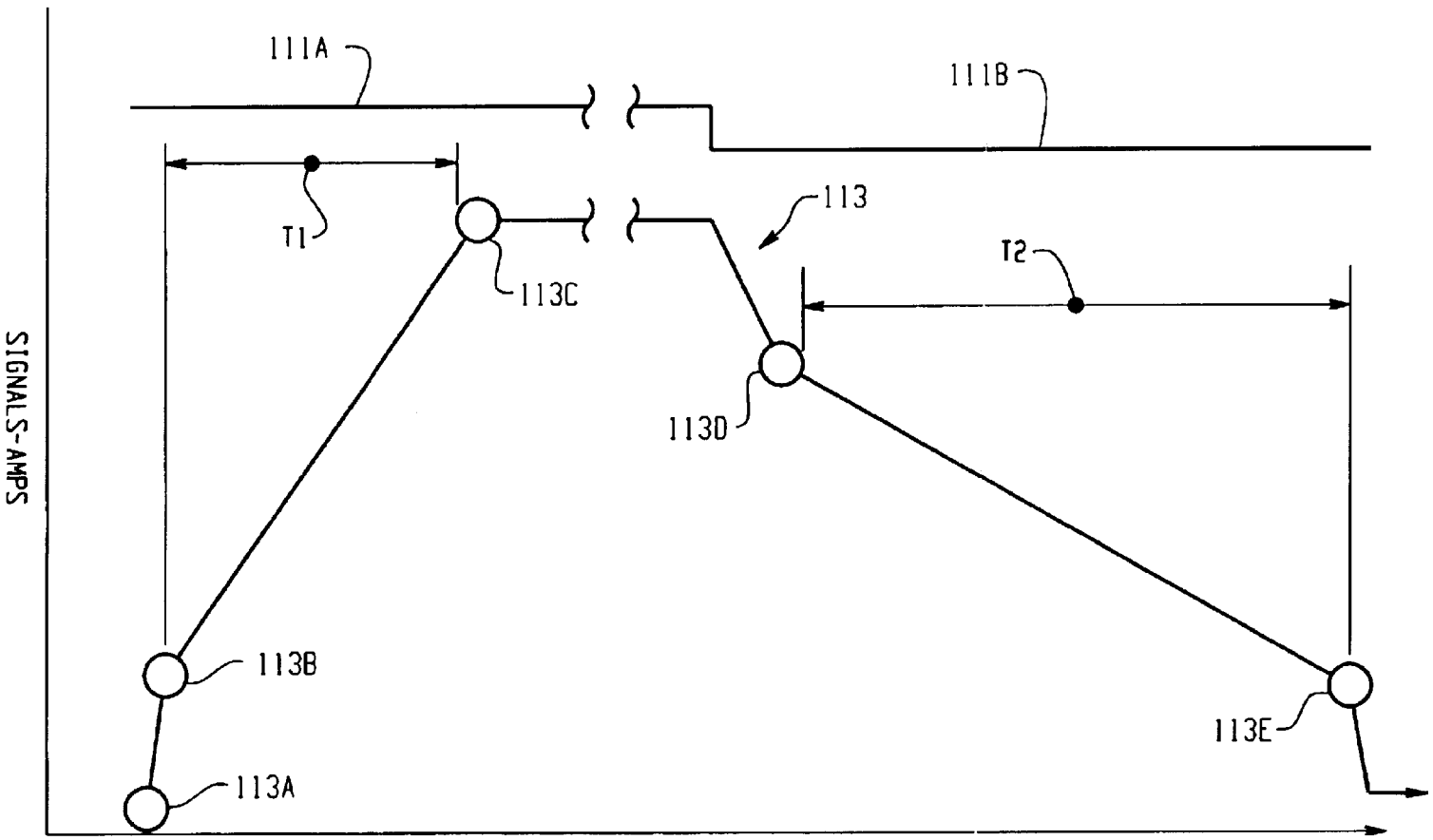
FIG. 5 is a graph illustrating both the input signal, from the vehicle operator, as well as the command signal to the pressure control valve, both as a function of time, in accordance with the improved control method of the present invention.

In connection with the subsequent description of the shift control method of the present invention, it should be understood that, in the subject embodiment, the amplitude of the command signal, generally designated 113 in FIG. 5, is substantially proportional to the pilot pressure signal 71 being communicated by the pressure control valve 75. Such proportionality is not an essential feature of the invention, but is preferred, partly to facilitate visualization of the operation and effect of the shift control method of the invention.

In accordance with one of the benefits of the invention, it should be noted that, preferably, the software embedded within the motor control logic 103 would incorporate certain values which could be either varied from one vehicle application to the next (and set as a "constant value"), or read by the logic during the operation of the vehicle (as a "variable value"). An example of a "constant value" could be the weight of the vehicle or some customer preferred operating parameter. An example of a "variable value" could be the instantaneous speed of the vehicle. It is believed to be clear to those skilled in the art of vehicles and multi-speed motors that a method of controlling the shifting of a multi-speed motor should take into account factors and parameters such as vehicle weight and vehicle speed. It is also believed to be within the ability of those skilled in the art, subsequent to a reading and understanding of the present specification, to select the various other constants and variables, for a particular vehicle, to be included in the software of the control logic 103, to achieve optimum shifting of that particular vehicle.

Referring now primarily to FIG. 5, when the vehicle operator moves the shift lever 109 from the position shown in FIG. 2 to the HSLT position, the input signal 111A is transmitted to the control logic 103. In accordance with the present invention, when the input signal 111A is received by the control logic 103, the command signal is changed from a "minimum" signal 113B to a "start signal" 113B. As may be seen in FIG. 5, the change from the minimum signal 113A to the start signal 113B occurs rather quickly so that, almost instantaneously, the pressure signal 71 rises to a pressure about equal to, or slightly below, the force of the spring 63. In other words, the shift valve spool 61 is quickly brought to a condition from which it is just about ready to initiate shifting toward the HSLT mode.

The control logic 103 then varies the command signal 113 from the start signal 113B to a "maximum" signal 113C, corresponding to a maximum pressure signal 71, needed to fully achieve the shifting of the motor 10 from the LSHT mode to the HSLT mode. In the appended claims, the start signal 113B may comprise the recited "first signal", while the maximum signal 113C may comprise the recited "second signal". By way of example only, the pressure signal 71 could now rise to approximately "charge" pressure, which on many vehicle propel systems could be in the range of about 400 psi to about 500 psi. In accordance with one aspect of the present invention, the control logic 103 utilizes the various variables and constants built into the software, to achieve the change in the pressure signal 71, and thus the shift to the HSLT mode, in what is considered the optimum time (shown in FIG. 5 as "T1") for the particular vehicle application. Although in FIG. 5 the transition from the start signal 113B to the maximum signal 113C (referred to as the "up-ramp") is represented as a linear change, those skilled in the art will understand that such is not essential to the invention, and any sort of non-linear or part-linear transition may be utilized. For example, the "gain" of the transition may start slowly, for control and stability reasons, and then accelerate toward the maximum signal 113C.

By way of example only, in connection with the development of the present invention the control logic 103 was programmed for use with a 2-speed motor for installation on a skid steer loader weighing approximately 8000 pounds. The time T1 for the transition from the start signal 113B to the maximum signal 113C (from the LSHT mode to the HSLT mode) was set to be between about 1.0 and about 1.5 seconds.

At some point in time during the operation of the vehicle, the operator determines that it is appropriate to downshift from the HSLT mode back to the LSHT mode, and therefore, the operator moves the shift lever 109 back to the LSHT position shown in FIG. 2. The movement of the shift lever 109 results in the input signal changing from the signal 111A back to the signal 111B. The control logic 103, in response to the change in the input signal (from 111A to 111B), quickly reduces the command signal from the maximum signal 113C to an "upper" signal 113D which is selected to take into account the likely hysteresis of the system and put the shift valve spool 61 in a condition in which it is still in the recirculation mode, but is just about at the point of returning to the position shown in FIG. 2. It should be understood that reducing the command signal from the level of the maximum signal 113C to the level of the upper signal 113D, before performing the next control step, is optional, for purposes of the present invention.

After the pressure signal 71 is reduced to a pressure corresponding to the upper signal 113D, the control logic 103 then, in accordance with a very important aspect of the invention, utilizes the variables and constants built into the software to change the command signal from the upper signal 113D to a "lower" signal 113E in a manner which is optimum for the particular vehicle application. In the appended claims, the upper signal 113D may comprise the "second signal", while the lower signal 113E may comprise the recited "first signal" (in reference to shifting to "said first condition"). As may be seen in FIG. 5, the transition (referred to as the "down-ramp") from the upper signal 113D to the lower signal 113E is accomplished over a time period T2 which is preferably greater than the up-ramp time T1. In the subject embodiment, and by way of example only, the time T2 for the transition (down-ramp) from the upper signal 113D to the lower signal 113E (from the HSLT mode to the LSHT mode) was set to be between about 1.5 and about 3.0 seconds in the control logic 103 used in connection with the skid steer loader mentioned previously, by way of example.

It may be seen in FIG. 5 that the lower signal 113E corresponds approximately to the start signal 113B (which is one reason they may both be referred to as the "first signal" in the appended claims), and therefore, at the end of the down-ramp, the pressure signal 71 will again be approximately equal to (or probably a little lower than) the force of the spring 63, to be sure to return the shift valve spool 61 to the position shown schematically in FIG. 2. If desired, after the command signal has been reduced, over the down-ramp time T2, to the lower signal 113E, it may then be quickly reduced further, down to approximately the level of the minimum signal 113A, to be sure that the shift valve spool 61 remains in the non-recirculating position shown in FIG. 2.

Those skilled in the controls art will understand that, although the graph of FIG. 5 shows the signals 111 and 113 in terms of current, the various ramping operations described above could be quantified in terms of voltage. However, the signals have been shown in terms of current herein to avoid having to compensate for system variables such as the temperature of the coil in the solenoid portion 115.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A method of controlling the shifting of a multiple-speed ratio fluid pressure operated device between a first speed ratio and a second speed ratio, said device including a fluid pressure displacement mechanism defining a plurality of expanding and contracting fluid volume chambers; a motor valve operable to provide fluid communication to and from said fluid volume chambers in said first speed ratio; a shift valve operable, in a first condition, to achieve said first speed ratio, and in a second condition, to achieve said second speed ratio by interconnecting a plurality of said volume chambers as recirculating volume chambers; said method comprising the step of shifting said shift valve between said first and second conditions in response to changes in a pilot pressure signal between a first pressure and a second pressure; said method being characterized by:

(a) providing a pressure control valve in fluid communication with a source of pressurized fluid, said pressure control valve being operable to communicate said pilot pressure signal to said shift valve in response to changes in an electrical command signal between a first signal and a second signal;

(b) when a shift to said second condition is commanded, changing said electrical command signal from said first signal to said second signal over a first time period (T1); and (c) when a shift to said first condition is commanded, changing said electrical command signal from said second signal to said first signal over a second time period (T2), wherein T2 is greater than T1.

2. A method of controlling the shifting of a multiple-speed ratio fluid pressure operated device as claimed in claim 1, characterized by said first speed ratio comprises a low-speed, high-torque condition, corresponding to said first condition of said shift valve, and said second speed ratio comprises a high-speed, low-torque condition, corresponding to said second condition of said shift valve.

* * * * *